US007276864B2

(12) United States Patent
Haruna et al.

(10) Patent No.: US 7,276,864 B2
(45) Date of Patent: Oct. 2, 2007

(54) DISCHARGE LAMP LIGHTING DEVICE AND PROJECTION TYPE IMAGE DISPLAY APPARATUS HAVING THE SAME

(75) Inventors: Fumio Haruna, Yokohama (JP); Masaru Shimizu, Kamakaura (JP); Kouji Kitou, Hiratsuka (JP); Tetsunosuke Nakamura, Yokohama (JP)

(73) Assignee: Hitachi Media Electronics Co., Ltd., Iwate (JP)

( * ) Notice: Subject to any disclaimer, the term of this patent is extended or adjusted under 35 U.S.C. 154(b) by 0 days.

(21) Appl. No.: 11/482,726

(22) Filed: Jul. 10, 2006

(65) Prior Publication Data

US 2007/0126374 A1 Jun. 7, 2007

(30) Foreign Application Priority Data

Dec. 5, 2005 (JP) ..... 2005-350348
Jan. 31, 2006 (JP) ..... 2006-022078

(51) Int. Cl.
*G05F 1/00* (2006.01)

(52) U.S. Cl. ..... 315/308; 315/224; 315/226

(58) Field of Classification Search ..... 315/209 R, 315/224, 226, 246, 283, 287, 291, 307, 308, 315/360, 362; 359/237, 298, 443
See application file for complete search history.

(56) References Cited

U.S. PATENT DOCUMENTS 6,239,558 B1 * 5/2001 Fujimura et al. ..... 315/307
6,583,587 B2 * 6/2003 Ito et al. ..... 315/308
6,911,781 B2 * 6/2005 Yamazaki et al. ..... 315/169.3
7,019,465 B2 * 3/2006 Muramatsu et al. ..... 315/226
7,176,638 B2 * 2/2007 Ito et al. ..... 315/307
2005/0035727 A1 * 2/2005 Muramatsu et al. ..... 315/291
2005/0168160 A1 * 8/2005 Clavier ..... 315/224

FOREIGN PATENT DOCUMENTS

| | | |
|---|---|---|
| JP | 05-074583 | 3/1993 |
| JP | 2003-272879 | 9/2003 |
| JP | 2004-281381 | 10/2004 |
| JP | 2005-353488 | 12/2005 |
| WO | WO95/35645 | 12/1995 |

* cited by examiner

*Primary Examiner*—Trinh Dinh
*Assistant Examiner*—Tung X Le
(74) *Attorney, Agent, or Firm*—Antonelli, Terry, Stout & Kraus, LLP.

(57) ABSTRACT

A computing circuit computes a target value of a current to be supplied to a discharge lamp and generates a pulse control signal for superpose a pulse current. Furthermore, the computing circuit controls a current control circuit so that a pulse current is superposed on a lamp current at a predetermined cycle and power supplied to the discharge lamp is kept constant. For that purpose, the computing circuit lowers a DC current level of the lamp current when a pulse current is superposed on the lamp current, and exercises control so that an integrated amount of power at a predetermined cycle is equalized to a predetermined integrated amount of power.

20 Claims, 4 Drawing Sheets

DISCHARGE LAMP LIGHTING DEVICE AND PROJECTION TYPE IMAGE DISPLAY APPARATUS HAVING THE SAME

CLAIM OF PRIORITY

The present application claims priority from Japanese applications serial no. JP2005-350348, filed on Dec. 5, 2005 and serial no. JP2006-022078, filed on Jan. 31, 2006, the contents of which are hereby incorporated by reference into this application.

BACKGROUND OF THE INVENTION

The present invention relates to an image display apparatus such as a liquid crystal projector and a discharge lamp lighting device used in the image display device, and more specifically to a technique for superposing pulse waves of a lamp current.

A high voltage discharge lamp (discharge lamp) having high conversion efficiency and functioning as a point source of light such as a metal halide lamp or a high voltage mercury lamp is now used as a light source for an image display device such as a liquid crystal projector or the like. To light a high voltage discharge lamp, a voltage and a current necessary for lighting the lamp are supplied from a dedicated discharge lamp lighting device. Sometimes the flickering phenomenon may occur in a discharge lamp due to movement of a starting point of a discharge arc while the discharge lamp is lighted. To stabilize the operation of a discharge lamp lighting device, several techniques have been proposed.

Japanese Patent Laid-open No. 5-74583 discloses a technique in order to provide a HID (high intensity discharge) lamp lighting device with high lighting efficiency by maintaining the power consumption of the HID constant. In this technique, the power consumption of the HID lamp is computed based on a lamp current flowing in the HID lamp and a voltage difference between both ends of the HID lamp. In addition, a value of current supplied to the HID lamp is controlled according to a difference between the computing result and a preset value. The computing is performed by a microprocessor.

International Publication No. WO 95/35645 discloses a configuration in which an AC lamp current on which a current pulse with a predetermined cycle is superposed is supplied to a high voltage lamp in order to suppress its flickering occurring when the lamp is lit.

Japanese Patent Laid-open No. 2004-281381 proposes a lamp current control circuit for stabilizing power at a constant level by suppressing the flickering of a high voltage discharge lamp during lighting and also keeping brightness of the lamp at a constant level for the purpose of stabilizing control and extending the life of the lamp. "Detailed Descriptions of the Embodiments" in the publication teach that "the amplitude waveform of a lamp flicker reduction step signal 57 superposed on an AC lamp current provides a step signal 18 bout well balanced in the vertical direction even when adjusted with a resister 31*a*, and an average value of the waveforms remains unchanged. As a result, the lamp current remains unchanged, and a lamp can be lit more smoothly while reducing flickering in the lamp" (paragraph [0051]). In addition, a waveform of the step signal is shown, for instance, in FIG. 3 in the document.

SUMMARY OF THE INVENTION

To stabilize operations of a discharge lamp, it is desirable to maintain power consumption at a constant level as described in Japanese Patent Laid-open No. 5-74583 and also to superpose pulse waves on a lamp current as described in WO 95/35645. In this case, current control and superposition of pulse waves are preferably performed by a microprocessor. Control of pulse wave superposition by a microcomputer is, however, disadvantageously low in response characteristic. This phenomenon is caused by responsiveness of a feedback control system. More specifically, it takes time from a point of time when the microcomputer outputs a control signal for switching a lamp current until a point of time when the lamp current actually changes like pulses, resulting in a blunting pulse waveform. As a result, the effect of prevention of flickering when a lamp is lit or of prolongation of the life of the lamp is not sufficient.

With the method described in WO 95/35645, although flickering can be reduced by superposing current pulses, an amount of the current increases in proportion to the added current pulses. As a result, the total power disadvantageously becomes larger than a target value.

Furthermore, in the method described in Japanese Patent Laid-open No. 2004-281381, when current pulses are superposed to kept power at a constant level, a total current (namely, power) is stabilized at a constant level by reducing pulses in a former stage by an amount of pulses added in a latter stage. In this method, a zone in which pulses are reduced and a zone in which pulses are added repeat alternately, and this allows the circuit to require a high response characteristic. When the response characteristic is not sufficiently high, the pulse waves become dull, and the desired effect of suppression of flickering can not be achieved.

An object of the present invention is to prevent pulse waves from becoming dull by enabling high-speed superposition of pulses on a lamp current. Another object of the present invention is to prevent pulse waves from becoming dull by enabling high-speed superposition of pulses on a lamp current while maintaining power at a constant level.

In one aspect of the present invention, a lamp lighting device includes a computing circuit which computes a target value of a current to be supplied to a discharge lamp and also generates a pulse control signal for superposing a pulse current on the supplied current, and a current control circuit for controlling a current to be supplied to a discharge lamp based on the target current value and the pulse control signal. The current control circuit has an error amplifier which compares a detected value of a current supplied to a discharge lamp to a target current value, and also has a level select switch which lowers an input level of a detected value of a current inputted to the error amplifier by an amount of the pulse current to be superposed, during a period of superposition of the pulse current based on the pulse control signal.

The level select switch includes a plurality of pairs of resistors and switches connected in parallel to the input end of a detected value of a current to the error amplifier, and selects ON/OFF of each of the plurality of switches based on a pulse control signal.

Alternatively, the level select switch includes an amplifier which amplifies a level of a detected value of a current inputted to the error amplifier, and switches a gain in the amplifier based on a pulse control signal.

In another aspect of the present invention, a discharge lamp lighting device includes a current control circuit which controls power supplied to a discharge lamp, and a computing circuit which superimposes a pulse current at a predetermined cycle on a lamp current for a discharge lamp and controls the current control circuit to make power constant based on voltage information and current information for power supplied to the discharge lamp. The computing circuit exercises control so that integral power consumption at a predetermined cycle is at a predetermined value by reducing a DC current level of a lamp current when a pulse current is added and superposed on the lamp current.

The computing circuit lowers a DC current level of a lamp current when a pulse current is superposed on a lamp circuit so that the integrated amount of power when the pulse current is superposed at a predetermined cycle is equalized to that when the pulse current is not superposed.

When the voltage applied to the discharge lamp is regarded constant at a predetermined cycle, the computing circuit exercises control so that integral power consumption at a predetermined cycle is at a predetermined value.

An image display device according to the present invention includes a discharge lamp lighting device for lighting a discharge lamp, an image display element for forming an optical image corresponding to an image signal by modulating light emitted from the discharge lamp lighting device, a drive circuit for driving the image display element based on an image signal, and an optical system for projecting light that has passed through the image display element on a screen.

DETAILED DESCRIPTION OF THE PREFERRED EMBODIMENTS

Preferred embodiments of the present invention will be described below with reference to the accompanying drawings.

Figure 1:
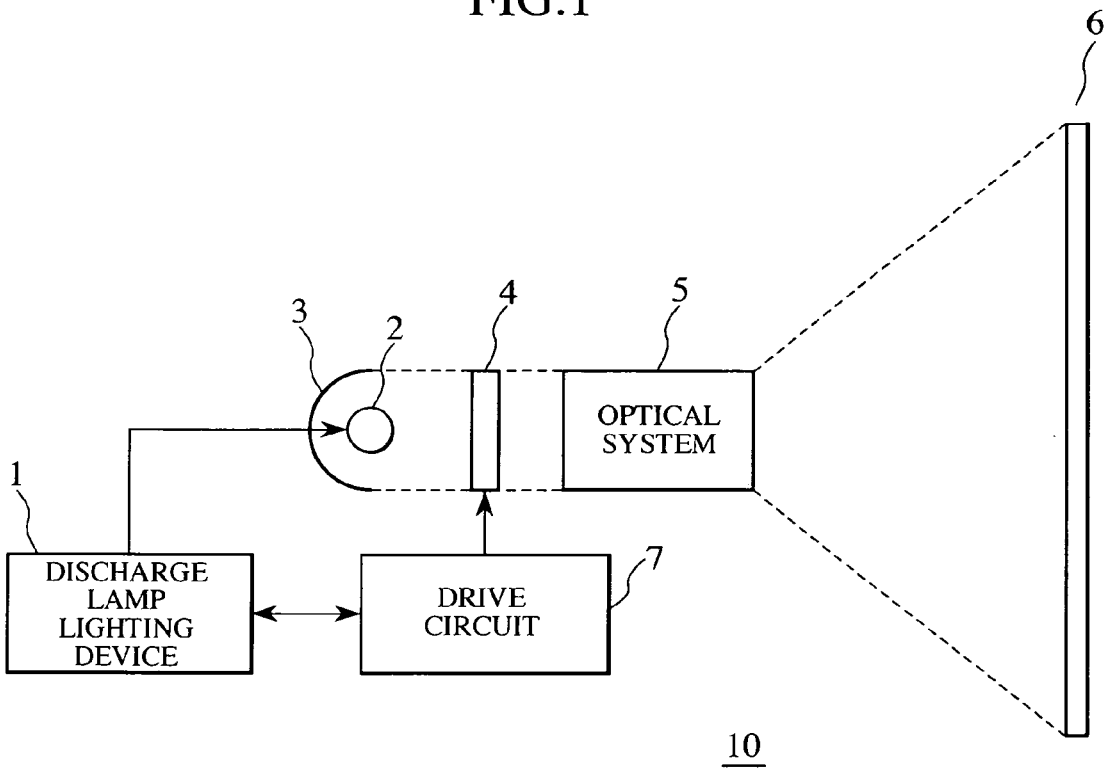
FIG. 1 is a schematic of a projection image display device using a discharge lamp lighting device by way of example.

FIG. 1 is a schematic of a projection image display device 10 using a discharge lamp lighting device according to an embodiment. Light emitted from a discharge lamp 2 constituting a light source unit is reflected by a reflector 3, and is directed to an image display element 4 from its rear surface. Light passing through the image display element 4 is projected by an optical system 5 onto a screen 6. The image display element 4 is, for instance, a liquid crystal panel, and is driven by a drive circuit 7 based on an image signal to modulate the projected light according to the image signal, thereby forming an optical image. The optical image is projected onto the screen 6 on a larger scale and displayed as an image. The discharge lamp lighting device 1 exercises control on the activation and lighting of the discharge lamp 2.

Figure 2:
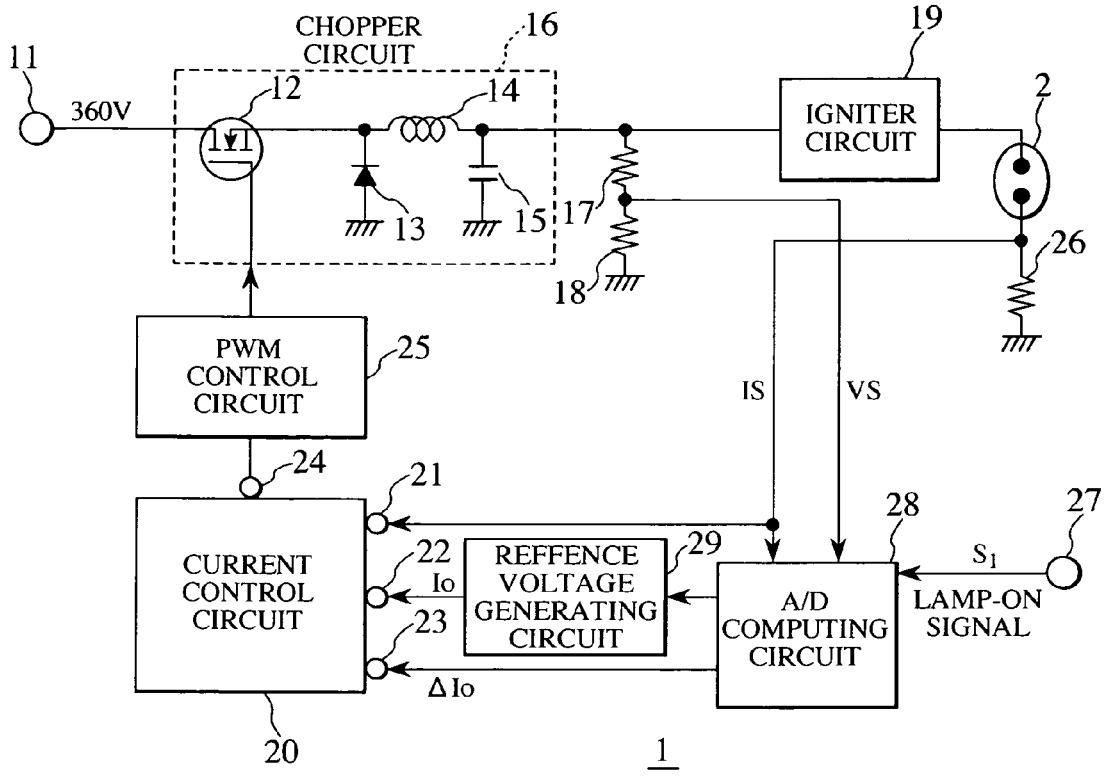
FIG. 2 is a circuit configuration diagram of the discharge lamp lighting device by way of example.

FIG. 2 is a circuit diagram of the discharge lamp lighting device 1 according to the embodiment. Reference numeral 11 denotes a power input terminal, 12 a MOS-FET, 13 a diode, 14 a choke coil, 15 a capacitor, 16 a chopper circuit, 17, 18 and 26 resistors, and 19 a igniter circuit. The igniter circuit 19 generates a high voltage pulse for starting lighting of the discharge lamp 2 based on an output from the chopper circuit 16. Reference numeral 25 denotes a PWM (pulse width modulation) control circuit for controlling the chopper circuit 16, and 20 a current control circuit for controlling the PWM control circuit 25.

Input terminals of the current control circuit 20 include an input terminal 21 for receiving a voltage generated in a resistor 26 resulting from a lamp current flowing through the discharge lamp 2 (referred to as the IS voltage hereinafter); an input terminal 22 for receiving a reference voltage Io; and an input terminal 23 for receiving a pulse wave superposition control signal ΔIo. Reference numeral 24 denotes an output terminal for outputting a current control signal from the current control circuit 20.

Reference numeral 27 denotes a terminal for receiving a signal for starting lighting of the discharge lamp 2 (referred to as a lamp ON signal, hereunder), and 28 denotes a computing circuit. Reference numeral 29 denotes a reference voltage generating circuit for generating a reference voltage based on an output from the computing circuit 28.

The computing circuit 28 is composed of, e.g., a microcomputer, and detects an output voltage (referred to as VS voltage below) from the chopper circuit 16 on the basis of the voltages divided by the resistors 17, 18 by means of an analog/digital converter AD incorporated therein. The computing circuit 28 computes a target amount of a current to be supplied to the discharge lamp 2 to adjust an output voltage from the discharge lamp 2 at a predetermined value and generates a reference signal (PWM signal). The reference voltage generating circuit 29 is composed of, e.g., a low-pass filter, generates a reference voltage Io, and outputs the reference voltage Io to the terminal 22.

Furthermore, in order to superpose a pulse current ΔI to an output current I from the discharge lamp 2, the reference processing circuit 28 outputs to the terminal 23 a voltage ΔIo obtained by multiplying the reference voltage Io by a current ratio of ΔIo/I during the period in which the pulse current is to be superposed.

The computing circuit 28 compares a detected output voltage VS to a predetermined upper limit value $LV_1$ and a lower limit value $LV_2$. When it is determined as a result of the comparison above that the VS value is not lower than $LV_1$ or not higher than $LV_2$, the computing circuit 28 sends a control signal to the current control circuit 20 to stop lighting of the discharge lamp lighting device 1. When the computed target amount of current is equal to or more the upper limit $LV_1$ of an output current from the discharge lamp 2, the computing circuit 28 is controlled to restrict the reference voltage Io so that the output current is equal to the upper limit $LV_1$ or below.

The current control circuit 20 controls an output from the chopper circuit 16 by outputting a current control signal from the terminal so that the detected voltage IS for the output current from the discharge lamp 2 inputted to the terminal 21 is equalized to the reference voltage Io to be inputted to the terminal 22. Furthermore, the current control circuit 20 superposes a pulse current having a predetermined waveform onto a lamp current according to a pulse wave superposition control signal ΔIo inputted to the terminal 23. The operation will be described in detail below.

Figure 3:
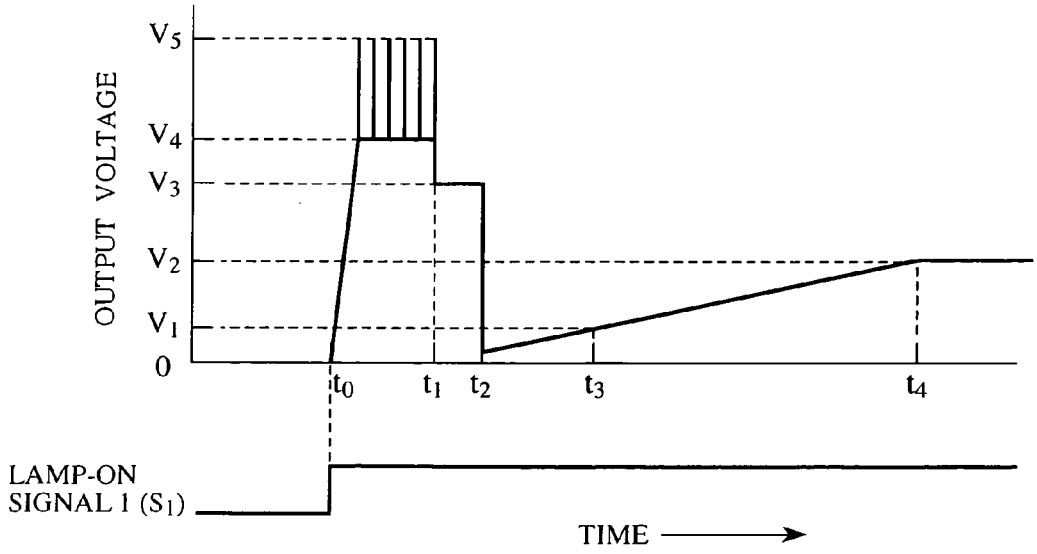
FIG. 3 is a timing chart showing changes in the output voltage of a discharge lamp.

FIG. 3 is a timing chart showing changes in an output voltage from a discharge lamp from a point of time when the discharge lamp is activated until a point of time when the discharge lamp is lit in the stable condition. An operation of the discharge lamp lighting device 1 will be described with reference to the timing chart. A power voltage is applied to the discharge lamp lighting device 1 and a lamp ON signal $S_1$ is inputted from the lamp ON input terminal 27 at time point $t_0$ (high). Because the discharge lamp lighting device 1 is not lit before the time point $t_0$, a voltage $V_4$ determined by the reference voltage is outputted from the chopper circuit 16. Furthermore, high voltage pulses are superposed on the voltage $V_4$ from the igniter circuit 19 to provide a maximum voltage $V_5$, and the voltage $V_5$ is applied to the discharge lamp 2 to activate and light the discharge lamp 2. At time point $t_1$, glow discharge with a high voltage and a small current is started, and the voltage changes to $V_3$. Furthermore, at time point $t_2$, arc discharge with a low voltage and a large current is started with a constant current control mode effected. In the discharge lamp 2, a temperature rises because of the discharges above and also the lamp voltage rises. Then, the chopper circuit 16 enters the constant power control mode and supplies power to the discharge lamp 2 at a constant level. Then the lamp voltage further rises and reaches the constant voltage $V_2$ at time point $t_4$. The pulse current is superposed at time point $t_3$ and beyond.

Figure 4:
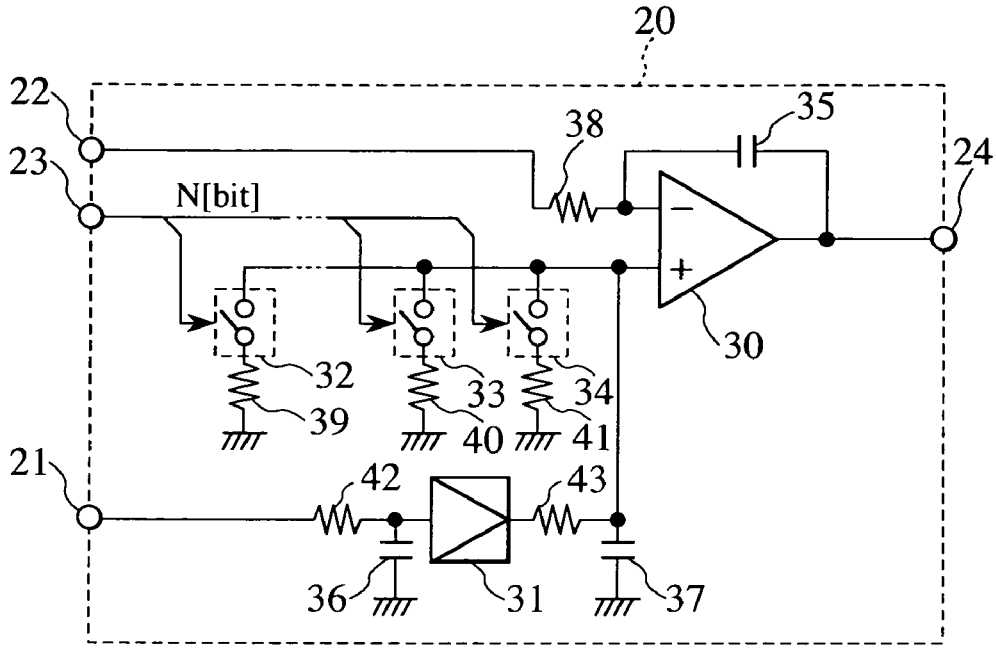
FIG. 4 is an internal diagram of a current control circuit 20 shown in FIG. 2 by way of example.

FIG. 4 is an internal diagram of the current control circuit 20 in the discharge lamp lighting device 1 shown in FIG. 2 by way of example. The reference voltage Io equivalent to the target current voltage computed by the computing circuit 28 is inputted to the input terminal 22, and is inputted to the minus side (reference value input side) of the error amplifier 30. The output voltage IS detected for the output current equivalent to the value of a current flowing through the discharge lamp lighting device 1 is inputted to the input terminal 21, and is inputted to the plus side (detected value input side) of the error amplifier 30. The voltage IS is amplified by an amplifier 31 via a low pass filter formed of a resistor 42 and a capacitor 36, and is sent via a low pass filter formed of a resistor 43 and a capacitor 37 to the plus side of the error amplifier 30. The output voltage (current control signal) 24 is controlled in the error amplifier 30 so that the two input voltages are equalized to each other.

An operation for superposing a pulse current to a lamp current in the discharge lamp 2 will be described below.

For comparison, the general method of superposing a pulse current will be described at first. In the general technique, a pulse wave superposition control signal ΔIo is superposed to the reference voltage Io for the target current value and is inputted to the input terminal 22 of the current control circuit 20, and then is inputted to the minus side of the error amplifier 30. In the error amplifier 30, the voltage IS for the output current inputted to the plus side is compared with the reference voltage Io after pulse wave superposition inputted to the minus side, and an current control signal 24 is outputted from the error amplifier 30. As a result, although a pulse current is superposed on the output current from the discharge lamp 2, there is a limit in a response speed in a control loop by the error amplifier 30, so that the pulse wave becomes dull and high-speed pulse superposition is difficult.

The problem described above is solved in this embodiment, and operations for superposing a pulse current in this embodiment are described below. In this embodiment, a pulse wave superposition control signal ΔIo is inputted, separately from the reference voltage Io, from the dedicated terminal 23 to the plus side of the error amplifier 30. More specifically, an ON/OFF switch 32 and a resistor 39 are connected to the input terminal in the plus side of the error amplifier 30. An enable signal for the switch 32 is inputted from the computing circuit 28. More specifically, the switch 32 is kept OFF while superposition of a pulse current is not being performed, and ON while superposition of a pulse current is being performed. When the switch 32 is turned ON, the voltage inputted to the input side of the error amplifier 30 drops by a voltage determined by the resistor 39. In other words, the voltage inputted to the input side of the error amplifier 30 is forcefully dropped only while superposition of a pulse current is being performed. The voltage inputted to the input side of the error amplifier 30 forcefully dropped acts to return to (restore) the original voltage value, and as a result, an output current for the discharge lamp can be risen to compensate the voltage drop. In this scheme, an output voltage (a current control signal) from the output terminal 24 of the error amplifier 30 little changes. That is to say, in this embodiment, the superposition of the pulse current less undergoes the influence of the response speed of the error amplifier 30, and therefore a pulse current can be superposed at high-speed.

Furthermore, a plurality (N pieces) of ON/OFF switches and a plurality (N pieces) of resistors having different resistance values may be parallel-connected to the plus side input end of the error amplifier 30. In this case, an N (bit) enable signal is given from the terminal 23 to the ON/OFF switches 32, 33, 34. For instance, by turning ON one of the N pieces of switches with the enable signal, a superposition ratio of a pulse current can be set to any one of N options. Furthermore, the $2^N$ options for the pulse current superposition ratio are available based on a combination of ON or OFF for each of the N switches.

Figure 5:
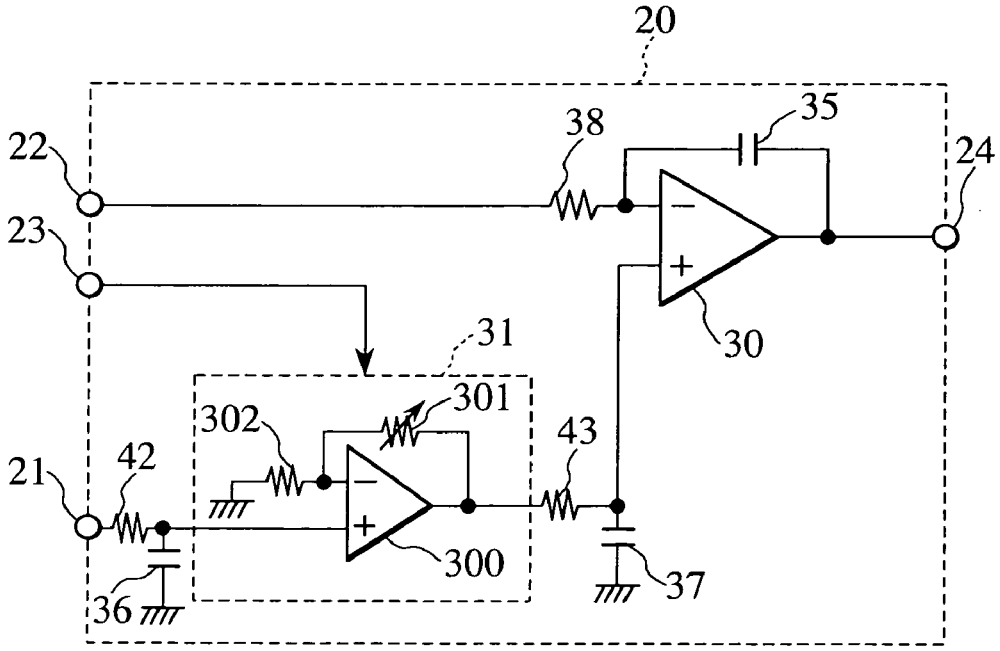
FIG. 5 is a internal diagram of a current control circuit 20 shown in FIG. 4 by way of modification.

FIG. 5 is an internal block diagram illustrating a variant of the current control circuit 20 shown in FIG. 4. The difference of the internal configuration shown in FIG. 5 from that shown in FIG. 4 is that the ON/OFF switches 32, 33, 34 and the resistors 39, 40, 41 are eliminated and a gain in an amplifier 31 is variable. More specifically, a return resistor 301 in an amplifier 300 is variable, and a gain of the amplifier 300 is dropped by changing a resistance value of the return resistor 301 with a pulse wave superposition control signal ΔIo. A change rate of a gain in this step is required only to be equalized to a rate of a pulse current to be superposed. The input voltage in the plus side of the error amplifier 30 forcefully dropped acts to return to (restore) the original voltage value, and as a result, an output current for the discharge lamp can be raised to compensate the grain drop. Also in this example, an output voltage from the error amplifier 30 remains essentially unchanged, and a pulse current can be superposed at high-speed.

In the embodiment described above, a pulse current is superposed by using means (a level select switch) for forcefully dropping a level of a detected value for a current for a discharge lamp inputted to the plus side (detected value input side) of an error amplifier in the current control circuit. Furthermore, by selecting a level of voltage drops from among a plurality of options, a superposition ratio of a pulse current can be selected.

In the embodiment described above, even when a pulse current is superposed on a discharge lamp current, it is possible to prevent the waveforms from becoming dull. Furthermore, sufficient effects can be produced for preventing flickering when a lamp is lit and for prolonging an operating life of a lamp.

The present invention is not limited-to the embodiment described above, and various modifications are allowable without departing from the gist of the present invention. In the embodiment described above, for the level switching means, resistors can be switched and a gain of the amplifier is variable, but the present invention is not limited to the configuration, and any technique for dropping a voltage may be used.

Next, a description is made of a control method for maintaining constant output power even when a pulse current is superposed on a lamp current.

Figure 6A:
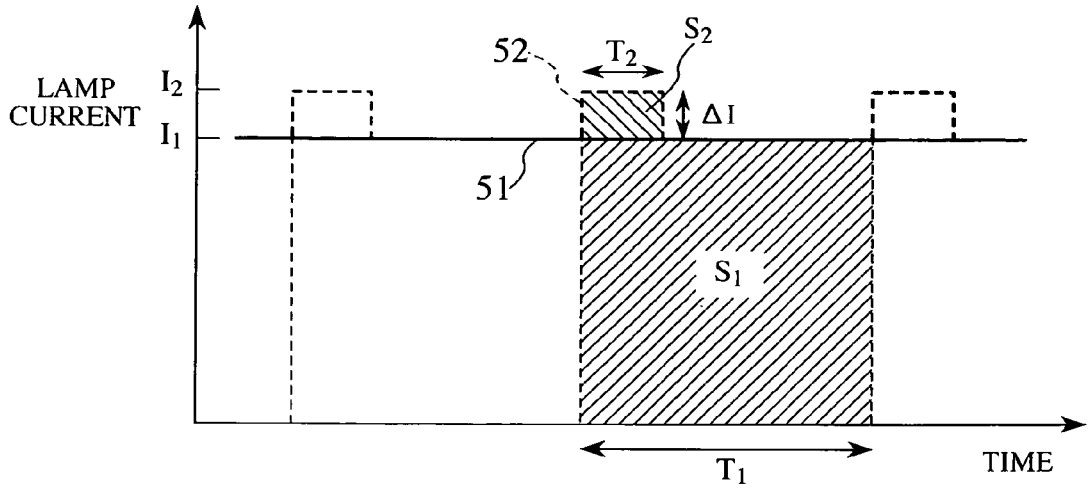
FIG. 6A and FIG. 6B are diagrams each illustrating a waveform of a lamp current when a pulse current is superposed.
Figure 6B:
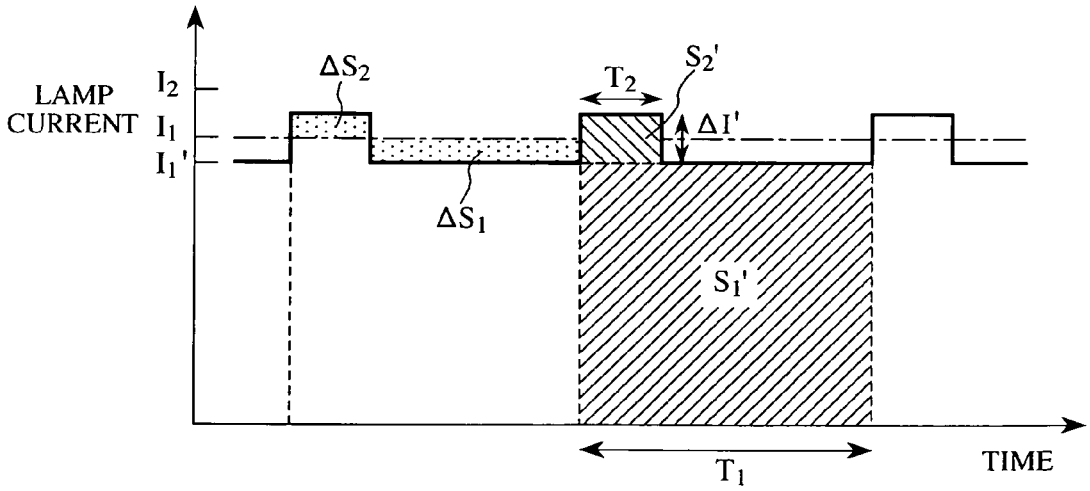

FIGS. 6A and 6B illustrate waveforms of a lamp current when a pulse current is superposed thereon. FIG. 6A illustrates a conventional example (in which power control is not exercised), while FIG. 6B shows the present embodiment (in which power is kept constant). A lamp voltage can be regarded as constant at a cycle when the pulse current is superposed, and therefore power can be kept constant by keeping the lamp current at a constant value. Therefore control for keeping the lamp current at a constant level will be described below.

In FIG. 6A, a solid line 51 indicates a lamp current before a pulse current is superposed, and the lamp current is a DC current at a constant level $I_1$ (DC current portion). It is assumed herein that a pulse current indicated by a broken line 52 (a pulse portion) is superposed at a cycle $T_1$ in this state. It is also assumed that a pulse time width of the pulse current is $T_2$, and a pulse amplitude is $\Delta I$ ($=I_2-I_1$). In this step, an integrated value for a current supplied to the discharge lamp in the period at the cycle $T_1$(referred to as integrated amount of the current) should be equal to a target value defined by the expression of $S_1=I_1\times T_1$ for the DC current portion) (An area of the shadowed section $S_1$ in FIG. 6A), and an integrated amount of the current $S_2=\Delta I\times T_2$ for the pulse portion (an area of the shadowed section $S_2$ in FIG. 6A) is added to the integrated value above. As a result, the total integrated amount of the current obtained by adding the DC current portion to the pulse portion will be supplied in excess of the target integrated value for the current $S_1$.

To solve the problem as described above, when a pulse current is superposed, adjustment (correction) is performed by lowering a level of a DC current portion of the lamp current so that the total amount of the current is equalized to the integrated amount of the current $S_1=I_1\times T_1$ as a target even when the pulse current is superposed. More specifically, the adjustment is performed by lowering the DC current level from $I_1$ to $I_1'$ and also correcting the pulse amplitude from $\Delta I$ to $\Delta I'$ so that a sum of the integrated amount of the current $S_1'$ for the DC current portion (an area of the shadowed section $S_1'$ in FIG. 6B) and the integrated amount of the current $S_2'$ for the pulse portion (an area of the shadowed section $S_2'$ in FIG. 6B) is equalized to the integrated amount of current $S_1$ (an area of the shadowed section $S_1$ in FIG. 1) as a target. The condition described above can be obtained through the operation described below.

As a parameter, a pulse superposition ratio $\alpha$ is set to $\Delta I/I_1$ ($\alpha=\Delta I/I_1$) and a ratio $\beta$ of the pulse time width $T_2$ to the cycle $T_1$ (a duty ratio) to $T_2/T_1$ ($\beta=T_2/T_1$). Parameters $\alpha$ and $\beta$ are predetermined coefficients and are kept constant also after correction. For instance, when $\alpha$ is 0.1, $\Delta I'$ after correction is always kept at 10% of $I_1$ after correction. The optimal value for $\alpha$ is determined according to a type of a discharge lamp, a flickering rate, or the like.

Since the total integrated amount of the current is equal to a target value and the pulse superposition ratio $\alpha$ is constant, $$I_1\times T_1=I_1'\times T_1+\Delta I'\times T_2\ ,\ \alpha=\Delta I/I_1=\Delta I'/I_1'$$

From the equations above, the correction values are set as follows:

$$I_1'=I_1/(1+\alpha\times\beta) \quad (1)$$

$$\Delta I'=\Delta I/(1+\alpha\times\beta) \quad (2)$$

When the pulse amplitude $\Delta I$ is to be kept constant even after correction ($\alpha$ changes after correction in this case), the corrections should be set as follows:

From $I_1\times T_1=I_1'\times T_1+\Delta I\times T_2$ $$I_1'=I_1(1-\alpha\times\beta) \quad (3)$$

$$\Delta I'=\Delta I \quad (4)$$

Furthermore, the pulse time width $T_2$ (namely a duty ratio $\beta$) may be made variable by correction. In this case, it is required only that the area $\Delta S_2$ in which a current is at the level $I_1$ or higher is equal to the area $\Delta S_1$ in which the current is at the level $I_1$ or lower, and therefore $I_1'$ and $\Delta I'$ should be corrected so that the following equations are satisfied:

$$(I_1'+\Delta I'-I_1)T_2=(I_1-I_1')(T_1-T_2)$$

$$(I_1-I_1')/\Delta I'=\beta \quad (5)$$

The operation described above is performed in the computing circuit 28, and a DC current level $I_1'$ and a pulse amplitude $\Delta I'$ of the lamp current after the correction as described above is set as a reference voltage Io as shown in FIG. 2. Alternatively, as shown in FIG. 4, $I_1'$ is set as the reference voltage Io and $\Delta I'$ as a pulse superposition $\Delta$Io.

The description above has been made of a method of keeping constant an integrated value of the lamp current at cycle $T_1$ (integrated amount of the current) when the lamp voltage is regarded as constant. When the lamp voltage is not constant, however, the equations are changed so that the integrated value of the lamp current (integrated amount of power) at the cycle $T_1$ is kept constant taking into consideration such fluctuations.

In the case described above, the control is exercised so that the power (integrated amount at the cycle $T_1$) when a pulse current is not superposed is equalized to that when the pulse current is superposed, but the present invention is not limited to this configuration. The equation may be modified to obtain power at a desired level.

In the embodiment described above, when a pulse current is superposed in the state where power is kept constant, there is a zone in which a pulse current is added to the DC current portion, but there is not a zone in which a pulse current is removed. Therefore, even when the response characteristic in the current control circuit 20 or the like is normal, desired controls can be provided for a lamp current. In conclusion, even when a pulse current is superposed onto a discharge current lamp at high-speed, the wave is prevented from becoming dull, which provides the sufficient effects in preventing flickering when the lamp is lit or in prolonging an operating life of the lamp.

The above embodiment has been described taking the configuration of a DC discharge lamp as an example. An amount of a lamp current can be controlled by the same method also in a case of an AC discharge lamp. For the AC discharge lamp, an AC current converting circuit is interposed between the chopper circuit 16 and the igniter circuit 19 to provide an AC lamp current. Then a pulse current having a polarity which is the same as or reverse to that of the AC lamp current is superposed, and the same computing method for correcting the lamp current and the pulse current may be applicable also in this case.

Generally a technique is used in which an operational life of a discharge lamp is prolonged by lowering a lamp current to a level lower than the ordinary level (low power mode), and also when pulse superposition is performed in such low power mode, an amount of the lamp current can be controlled by the method described in the embodiment above.

As described above, with the configuration according to the embodiment of the present invention, since precise control can be provided to keep power at a constant level, superposition of a pulse current on a lamp current can be performed at high-speed, and pulse wave can be prevented from becoming dull, the present invention is effective in preventing flickering when a lamp is lit and in prolonging an operational life of a lamp.

What is claimed is:

1. A discharge lamp lighting device for supplying power to a discharge lamp, the discharge lamp lighting device comprising:

a computing circuit which outputs a signal for a target value of a current supplied to the discharge lamp and a pulse control signal to superpose a pulse current on the supplied current; and a current control circuit which receives the signal for a target value and the pulse control signal and controls the current supplied to the discharge lamp, and which includes:

an error amplifier which compares a detected value of the current being supplied to the discharge lamp with the target value of the current; and a level select switch which lowers an input level of the detected value of the current inputted to the error amplifier based on the pulse control signal, during a period of superposition of the pulse current.

2. The discharge lamp lighting device according to claim 1, wherein the current control circuit lowers the input level of the detected value of the current by an amount of the pulse current to be superposed.

3. The discharge lamp lighting device according to claim 1, wherein the level select switch is formed with a plurality of pairs of resistors and switches connected in parallel to the detected value input end of the error amplifier.

4. The discharge lamp lighting device according to claim 3, wherein the level select switch selects ON/OFF of each of the plurality of switches according to the pulse control signal.

5. The discharge lamp lighting device according to claim 1, wherein the level select switch is an amplifier for amplifying a level of the detected value of the current inputted to the error amplifier.

6. The discharge lamp lighting device according to claim 5, wherein the level select switch selects a gain of the amplifier based on the pulse control signal.

7. The discharge lamp lighting device according to claim 1, wherein the current control circuit controls an amount of power integrated during the period of superposition of the pulse current.

8. The discharge lamp lighting device according to claim 7, wherein the current control circuit equalizes the amount of power integrated during the period of superposition of the pulse current to that during a period of non-superposition of the pulse current in a period having the same time length as that of the period of superposition.

9. A discharge lamp lighting device for lighting a discharge lamp by supplying power thereto, the discharge lamp lighting device comprising:

a current control circuit which controls power supplied to the discharge lamp; and a computing circuit which superposes a pulse current on a lamp current for the discharge lamp at a predetermined cycle and controls the power at a constant value based on information concerning a voltage and a current of the power supplied to the discharge lamp;

wherein the computing circuit exercises control to lower a DC current level of the lamp current when the pulse current is superposed on the lamp current, thereby bringing the integrated amount of power in the predetermined cycle to a specified value.

10. The discharge lamp lighting device according to claim 9, wherein the computing circuit equalizes the integrated amount of power when the pulse current is superposed at the predetermined cycle to that when the pulse current is not superposed.

11. The discharge lamp lighting device according to claim 9, wherein, when a voltage applied to the discharge lamp is constant at the predetermined cycle, the computing circuit superposes the pulse current on the lamp current and lowers a DC current level of the lamp current, thereby controlling the integrated amount of current.

12. The discharge lamp lighting device according to claim 9, wherein the integrated amount of the current when the pulse current is superposed is an additional value of a product of a DC current level of the lamp current and the predetermined cycle and a product of an amplitude of the pulse current and a time width of the pulse current.

13. An image display apparatus comprising:

a discharge lamp lighting device in turn comprising:

a computing circuit which outputs a signal for a target value of a current supplied to the discharge lamp and a pulse control signal to superpose a pulse current on the supplied current; and a current control circuit which receives the signal for a target value and the pulse control signal and controls the current supplied to the discharge lamp, and which includes:

an error amplifier which compares a detected value of the current being supplied to the discharge lamp with the target value of the current; and a level select switch which lowers an input level of the detected value of the current inputted to the error amplifier based on the pulse control signal, during a period of superposition of the pulse current;

an image display element which modulates light emitted from the discharge lamp lighting device to form an optical image corresponding to an image signal;

a drive circuit for driving the image display element based on the image signal; and an optical system that projects light passing through the image display element to a screen.

14. The image display apparatus according to claim 13, wherein the current control circuit lowers an input level of the detected value of the current by an amount of the pulse current to be superposed.

15. The image display apparatus according to claim 13, the level select switch is formed with a plurality of pairs of resistors and switches connected in parallel to the detected value input end of the error amplifier.

16. The image display apparatus according to claim 15, wherein the level select switch selects ON/OFF of each of the plurality of switches based on the pulse control signal.

17. The image display apparatus according to claim 13, wherein the level select switch is an amplifier for amplifying a level of the detected value of the current inputted to the error amplifier.

18. The image display apparatus according to claim 17, wherein the level select switch selects a gain of the amplifier based on the pulse control signal.

19. The image display apparatus according to claim 13, wherein the current control circuit controls an amount of power integrated during the period of superposition of the pulse current.

20. The image display device according to claim 19, wherein the current control circuit equalizes the amount of power integrated during the period of superposition of the pulse current to that during a period of non-superposition of the pulse current in a period having the same time length as that of the period of superposition.

* * * * *